United States Patent [19]

Kraus et al.

[11] 4,114,972

[45] Sep. 19, 1978

[54] WEDGE BASE BULB SOCKET

[75] Inventors: Willibald Kraus; Bodo Arthur Greulich, both of Kaiserslautern, Fed. Rep. of Germany

[73] Assignee: TRW Inc., Cleveland, Ohio

[21] Appl. No.: 809,221

[22] Filed: Jun. 23, 1977

[30] Foreign Application Priority Data

Jun. 23, 1976 [DE] Fed. Rep. of Germany ..... 2628127

[51] Int. Cl.[2] ..... H01R 33/06

[52] U.S. Cl. ..... 339/65; 339/176 L

[58] Field of Search ..... 339/176 L, 17 D, 59 L, 339/61 L, 65, 93 L

[56] References Cited

U.S. PATENT DOCUMENTS

| | | | |
|---|---|---|---|
| 3,140,301 | 8/1964 | Trautner et al. | 339/176 L |
| 3,324,442 | 6/1967 | Greasley | 339/17 D |
| 3,910,668 | 10/1975 | Wasmeier | 339/65 |

FOREIGN PATENT DOCUMENTS

| | | | |
|---|---|---|---|
| 274,102 | 11/1965 | Australia | 339/176 L |
| 1,294,521 | 11/1972 | United Kingdom | 339/176 L |

*Primary Examiner*—Neil Abrams

*Attorney, Agent, or Firm*—James R. O'Connor

[57] ABSTRACT

A molded plastic socket for a wedge base bulb has a bulb receiving cavity defined in part by resilient side walls for securely but releasably engaging the bulb base. The side walls also carry contacts connected to the socket terminals, which contacts also releasably grip the sides of the bulb base and electrically contact the wires leading to the bulb filament which are located on the outer sides of the bulb base. The bulb cavity is also defined by end walls which carry wire guides that direct the wires on the bulb into engagement with the socket contacts as the bulb is inserted into the socket cavity.

6 Claims, 8 Drawing Figures

WEDGE BASE BULB SOCKET

BACKGROUND OF THE INVENTION

This invention relates to a socket for accepting a bulb of the type having projecting contact wires and to an assembly of a bulb of this type mounted in the socket of the present invention.

Bulbs known as capless or wedge base bulbs are used in many applications. This type of bulb comprises a base which is oblong in section and formed integrally with the glass envelope of the bulb which houses the electric filaments. The contacts which are connected with the filaments comprise wires which extend out of the end of the base and are then bent back so as to overlap opposite sides of the base in offset relation to one another.

During transport and handling the contact wires of this type of bulb frequently become bent out of alignment. This can present a problem in ensuring adequate contact between the contact wires of the bulb and the contact elements in the socket.

In designing a socket to take this type of bulb it is known from British patent specification No. 1,323,601 to provide resilient arcuate members for gripping and centralising the base of the bulb as it is inserted into the socket and resilient metal contact elements one on each side of the arcuate members for gripping the base of the bulb and making resilient contact with the contact wires. However, this type of socket construction does not have any provision for dealing with the problems which can arise if the contact wires of the bulb are bent out of their normal alignment before the bulb is inserted into the socket. It is therefore an object of the present invention to provide a socket for a capless or wedge base bulb which includes means in the socket for automatically aligning the contact wires of the bulb with the contact elements in the socket as the bulb is inserted into the socket.

SUMMARY OF THE INVENTION

Accordingly the present invention provides a socket for a wedge base capless bulb comprising a body of insulating material, a cavity in the body to receive the base of the bulb, the cavity being defined by end walls and side walls and the side walls having resilient side wall portions adapted to grip the base of the bulb, resilient contact elements in the cavity adapted to grip opposite sides of the base of the bulb and to contact the contact wires of the bulb, and inclined guide surfaces on the walls of the cavity adapted to guide the contact wires of the bulb into parallel contacting relationship with the contact elements as the base of the bulb is inserted into the cavity.

Preferably, each end wall of the cavity has a pair of inclined guide surfaces, each of which guide surfaces faces a side wall and is inclined from the mouth of the cavity inwardly of the cavity and towards the adjacent facing side wall, each contact element being positioned on a side wall adjacent an end wall and facing an imaginary planar extension of an inclined guide surface and lying tangent to the plane of an edge of the guide surface.

In use, if a bulb has contact wires which are bent out of alignment, the contact wires will engage the guide surfaces in the socket as the base of the bulb is inserted into the socket and will be guided into their properly aligned position in which they are located in parallel contacting relationship with the contact elements of the socket thereby ensuring good electrical contact.

BRIEF DESCRIPTION OF THE DRAWINGS

A preferred form of the present invention will now be described with reference to the accompanying drawings in which.

DESCRIPTION OF A PREFERRED EMBODIMENT

Figure 1:
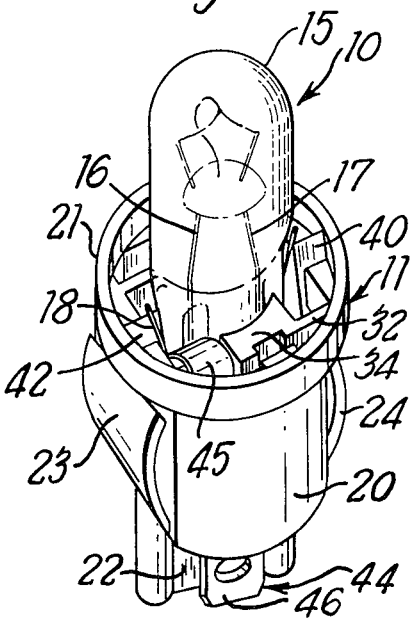
FIG. 1 is a perspective view of a wedge base capless bulb mounted in a socket according to the present invention.
Figure 6:
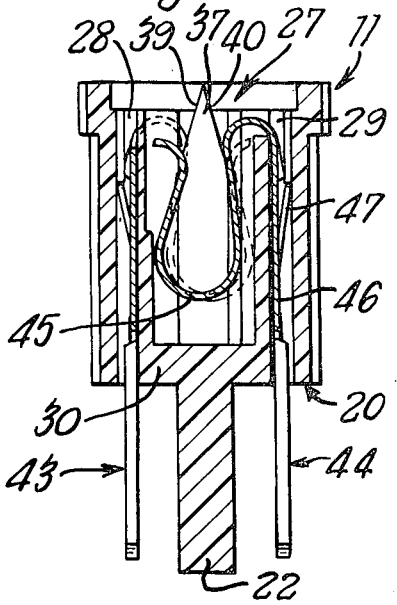
FIG. 6 is a section taken on the line VI—VI of FIG. 4.
Figure 7:
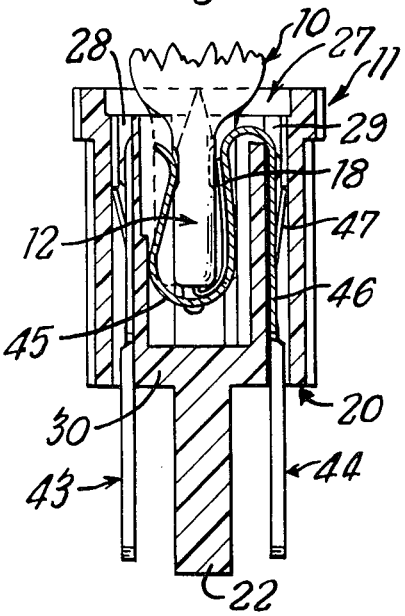
FIG. 7 is a fragmentary section of the bulb and socket of FIGS. 1 to 3.
Figure 2:
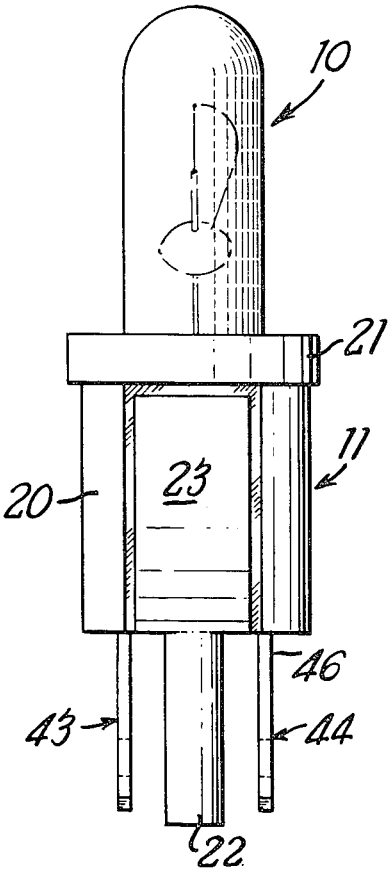
FIG. 2 is an elevation of the bulb and socket of FIG. 1.
Figure 3:
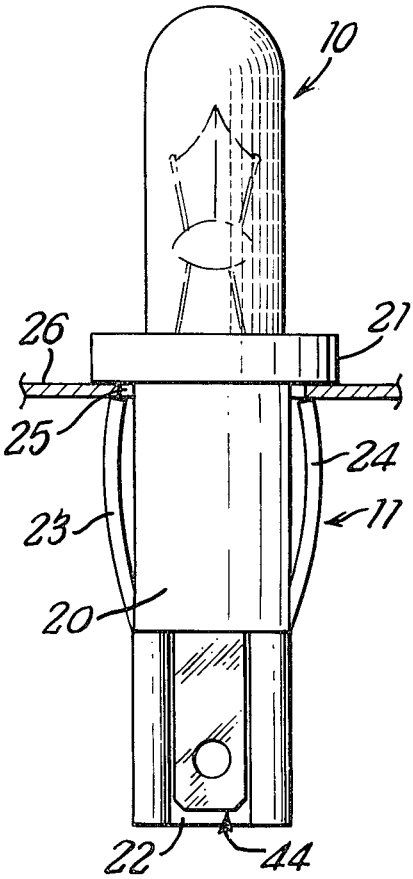
FIG. 3 is a side elevation of the bulb and socket shown in FIG. 2, the socket being mounted in a support panel.
Figure 4:
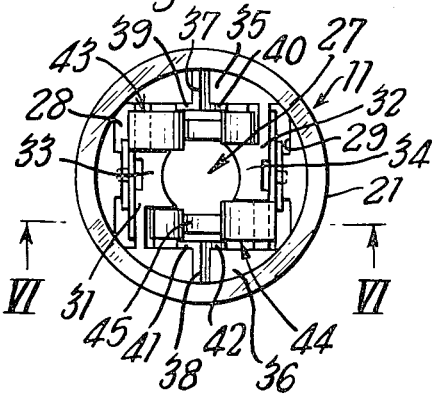
FIG. 4 is a plan view of the socket shown in FIGS. 1 to 3.
Figure 5:
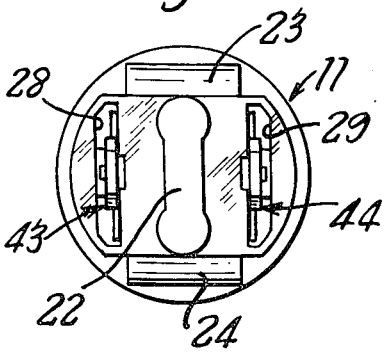
FIG. 5 is an under plan of the socket shown in FIG. 4.

In the drawings a wedge base capless bulb is indicated generally at 10 and is shown in FIGS. 1 to 3 mounted in a socket, which is indicated generally at 11.

Figure 8:
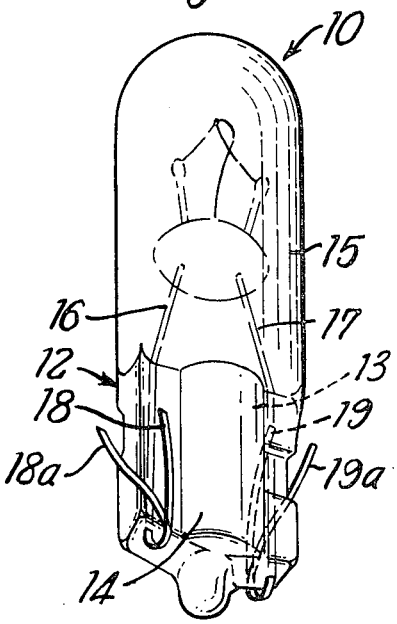
FIG. 8 is a perspective view from below of the bulb shown in FIGS. 1 to 3.

The bulb 10 is of the type comprising a base 12 which is oblong in section having two, central, part cylindrical and symmetrical raised ribs 13 and 14 extending outwardly from its opposite sides, and which is formed integrally with a glass envelope 15 containing filaments 16 and 17. The filaments are connected to contact wires 18 and 19 respectively which extend outwardly from the end of the base 12 and are then bent so as to extend back along opposite sides of the base in offset relation to one another. Normally the contact wires extend back along the base 12 in parallel but being relatively soft they can become bent out of alignment as shown in chain dotted line in FIG. 8.

The socket 11 which is designed to receive the base 12 of the bulb 10 comprises a main body 20 of insulating material, for instance a synthetic plastics material, which is generally oblong in transverse cross-section. The body 20 is formed at one end with a circular head 21 and at the other end with a tail 22. Two resilient tongues 23, 24 are attached to the end of the body adjacent the tail 22 and extend towards the head 21. The tongues are resilient and bowed outwardly of the body 20 so as to provide resilient snap-engaging means for attaching the socket, in a well known manner, in position through an aperture 25 in a support panel 26 as shown in FIG. 3. The aperture 25 is oblong in shape and immediately adjacent the head 21, the body 20 is externally rectangular so as to be nonrotatably locatable in the aperture 25.

The body 20 of the socket is formed with a central cavity 27 which opens out of the head end of the body 20 and with two longitudinally extending through slots 28 and 29 on opposite sides of the cavity 27. The cavity 27 is closed by a bottom wall 30 at the end of the cavity remote from the head 21. Side walls 31 and 32 of the cavity 27 are defined by flexible webs of material formed with longitudinally extending centrally positioned ribs 33 and 34 respectively. The ribs 33 and 34 are formed with longitudinally extending part cylindrical surfaces which are offset, i.e., asymmetrical, and adapted to resiliently grip the ribs 13 and 14 on the base of the bulb 10 to centralise and resiliently hold the base of the bulb within the cavity. End walls 35 and 36 of the cavity 27 are substantially rigid and provided with raised, wedge-shaped ribs 37 and 38 having inclined guide surfaces 39, 40 and 41, 42 respectively. Each guide surface faces an adjacent side wall and is inclined from an apex at the entrance to the mouth of the cavity 27 outwardly and towards the facing side wall as it extends from the entrance to the mouth of the cavity towards the bottom wall 30.

The metal contact elements which are indicated generally at 43 and 44 are mounted in the socket 11. The contact elements 43 and 44 are similar and only the contact element 43 will be described in detail. The contact element 44 is generally S-shaped comprising a resilient U-shaped contact portion 45 which is located within the cavity 27 between the end wall 35 and the ribs 33, 34 and which is compressed slightly between the side walls. The contact portion 45 is connected by a reverse bend to a substantially straight leg portion 46 which extends through the slot 29 and out of the body 20 of the socket a distance approximately equal to the length of the tail 22. The leg portion 46 is formed with a prong 47 which is adapted to bite into the wall of the slot 29 and resist removal of the leg portion 46 from the slot. The contact element 43 which is similar to the contact element 44 is mounted in the socket 11 in the same manner but located between the end wall 36 and the ribs 33 and 34. The leg portions 46 of the contact elements 43 and 44 which project from the end of the socket body 20 are adapted for electrical connection to wires or other conductive elements.

When the base 12 of the bulb 10 is inserted into the cavity 27 of the socket 11, the ribs 13 and 14 on the base of the bulb are aligned with the arcuate surfaces on the ribs 33 and 34 so as to locate the base of the bulb correctly as it enters the cavity 27. If the contact wires 18 and 19 of the bulb 10 are correctly aligned and lie in parallel flat against the side surfaces of the base 12 they will be gripped by the U-shaped contact portions 45 of the contact elements 43 and 44 so as to make a good electrical connection with the contact elements. If however the contact wires 18 and 19 have become bent and twisted into the positions shown at 18*a*, 19*a* in FIG. 8 there is a risk that they will become trapped between the side edges of the base 12 of the bulb and the end walls 35 and 36 of the cavity. If that happens, then either no electrical contact will be made with the contact elements 43 and 44 or at best only an imperfect contact. The guide surfaces 39 to 42 are designed to eliminate or substantially reduce the risk of this occurring.

The maximum cross-sectional dimension of the base 12 is approximately equal to the distance between the end walls 35 and 36 of the cavity. Consequently as the base 12 is inserted into the cavity 27, the contact wires 18 and 19 if they are bent out of alignment will engage the adjacent guide surfaces 39 and 42 and will be deflected back into their normal parallel relationship as the base 12 enters the cavity. It will be seen that the contact wires 18 and 19 emerge from the median line of the end of the base 12 of the bulb. It will also be seen that each of the guide surfaces extends inwardly of the cavity from a point approximately midway along the end wall of the cavity. Thus as the leading end of the base 12 enters the cavity the end of each contact wire 18 or 19 will be located between a guide surface and a side wall of the cavity even if the contact wire is bent out of alignment. A bent contact wire 18 or 19 will thus catch on the guide surfaces and there is little if any risk of a contact wire being trapped between an end wall of the cavity and the side edge of the base 12 of the bulb.

The arcuate surfaces of the ribs 33 and 34 are asymmetrical and offset. Since the ribs 13, 14 on the bulb are symmetrical, the bulb 10 is constrained to rotate counterclockwise (as viewed in FIG. 1) and is prohibited from rotating clockwise as it is inserted into the cavity 27 so as to direct the contact wires towards and into good electrical contact with the contact elements. The ribs 33 and 34 are integral with the webs 31 and 32 which are relatively flexible and which therefore provide a resilient grip on the base 12 of the bulb as it is inserted into the cavity.

It will be seen that we have provided means in a socket for a capless bulb for obviating or substantially reducing the risk of the contact wires of the bulb failing to make electrical contact with the contact elements in the socket. In the preferred embodiment of the invention the socket is provided with guide surfaces on the end walls of the socket cavity which face the side walls of the cavity and which are inclined towards the side walls as they extend inwardly of the cavity. However, it will be understood that the scope of the present invention is not limited to the specific embodiment of the invention described and illustrated herein but extends to any embodiment thereof falling within the scope of the following claims.

We claim:

1. A socket for a wedge base capless bulb having contact wires comprising a body of insulating material, a cavity in the socket body to receive the base of the bulb, the cavity being defined by end walls and side walls and the side walls having resilient side wall portions adapted to grip the base of the bulb, resilient contact elements adapted to grip opposite sides of the base of the bulb in contact with the contact wires of the bulb, each end wall of the cavity having an inclined guide surface, each of which guide surfaces faces a side wall and is inclined from the mouth of the cavity outwardly and towards the facing side wall, the guide surfaces being adapted to guide the contact wires of the bulb into substantially parallel contacting relationship with the contact elements as the base of the bulb is inserted into the cavity.

2. A socket as claimed in claim 1, wherein each contact element is positioned on a side wall adjacent an end wall and facing the plane of an inclined guide surface.

3. A socket as claimed in claim 1 wherein sections of the resilient side wall portions are arcuate and asymmetrical and are thereby adapted to rotatively urge the base of the bulb in a predetermined direction whereby the contact wires of the bulb are forced against the contact elements of the socket.

4. A socket as claimed in claim 1 wherein each end wall of the cavity has a pair of inclined guide surfaces.

5. A socket as claimed in claim 4, wherein each end wall of the cavity is formed with a raised wedge shaped rib having two inclined surfaces which constitute the said pair of guide surfaces.

6. A socket as claimed in claim 5 wherein the apex of each of the wedge-shaped ribs is located at the entrance to the mouth of the cavity in the socket body.

* * * * *